United States Patent [19]

Kerr

[11] 4,118,266

[45] Oct. 3, 1978

[54] METHOD FOR FORMING AN IMPROVED INSULATED METAL FRAME

[76] Inventor: Jack B. Kerr, 1300 Carlisle Pl., Deerfield, Ill. 60015

[21] Appl. No.: 794,981

[22] Filed: May 9, 1977

[51] Int. Cl.[2] ..... E04B 1/64; E06B 1/32

[52] U.S. Cl. ..... 156/293; 29/155 R; 29/462; 29/469.5; 52/309.3; 49/DIG. 1

[58] Field of Search ..... 156/293, 71, 315, 276; 49/DIG. 1, DIG. 2; 52/309.3, 442, 436, 393, 403, 309.16, 394, 395, 397–400, 730, 731; 29/155 R

[56] References Cited

U.S. PATENT DOCUMENTS

| | | | |
|---|---|---|---|
| 1,121,565 | 12/1914 | MacDowney | 52/400 |
| 1,986,694 | 1/1935 | Walker | 52/400 |
| 2,835,623 | 5/1958 | Vincent | 52/309.3 |
| 3,416,277 | 12/1968 | Wood | 52/442 |
| 3,818,666 | 6/1974 | Winans | 52/309.3 |
| 3,978,255 | 8/1976 | Smith | 428/119 |

FOREIGN PATENT DOCUMENTS

| | | | |
|---|---|---|---|
| 962,017 | 4/1957 | Fed. Rep. of Germany | 49/DIG. 1 |
| 110,600 | 1/1967 | Norway | 49/DIG. 1 |

*Primary Examiner*—John E. Murtagh

*Attorney, Agent, or Firm*—Leo J. Aubel; Gerald T. Shekleton

[57] ABSTRACT

A method and apparatus for a metal frame for windows, doors and the like which provides a thermal break between the interior and exterior surfaces of the frame. The frame comprises an interior frame portion which is coupled to an exterior frame portion through an insulated joint. Separating and insulating the interior frame portion from the exterior frame portion is a woven or matted fabric. Keeping the fabric in place and mechanically bonding the interior frame portion to the exterior frame portion is a resin which saturates the fabric between the two frame portions and is cured. The solid resin thereby obtained maintains the spaced distance of the two formed portions while securing them together to form a rigid unitary frame which is thermally nonconductive.

3 Claims, 10 Drawing Figures

METHOD FOR FORMING AN IMPROVED INSULATED METAL FRAME

BACKGROUND OF THE INVENTION

This invention relates to a method and apparatus for thermal insulation, and more particularly, to a thermal break means for use in windows and doors of building structures.

In the construction of building structures, it has been long recognized that a thermally "tight" structure aids in the prevention of drafts, the reduction of fuel bills and other desirable benefits. It is also known that in an otherwise well insulated building, major heat losses may be attributed to the openings in the building, specifically the doors and windows. In conventional applications, air has been used as the chief insulative means between the exterior surface and the interior surface. Of course, the most widely used is the conventional storm window which is generally attached to the building itself and is spaced one to three inches from the interior window. Another popular form of insulation for windows is the double pane method of glazing, wherein two panes of glass are hung parallel to one another and spaced roughly one-eigth of an inch by a rigid, non-conductive material such as wood and sealed air tight by a suitably resilient non-conductive material.

In the manufacture of windows with metal frames and doors with metal exteriors, various undesirable aspects of metal have been accepted in view of the overriding advantages of such a metal frame. For example, metal frames result in reduced maintenance since there is no painting or other upkeep as with wooden frames. Further, the metal does not warp or rot. However, such a frame is inherently an excellent conductor of heat, thereby causing a loss of building heat in the winter and a gain of building heat in the summer. In the winter the temperature differential between the frame and the inside air causes sweating on the frame surfaces as the interior moisture-laden air condenses on the cold surfaces of the frame. This condensation, if severe enough, will drip down and cause damage to walls, woodwork and sashes.

Various measures have been taken to prevent or retard this thermal conductivity of the exterior frame surfaces with the interior frame surface. These measures include windows having separate interior and exterior metal surfaces separated from each other through strips of rigid vinyl plastic or other semi-resilient insulative means. Other measures have included extruded parts which, when placed together, form a pocket which is filled with an initially flowable insulative medium such as a resin or the like. This insulative medium is cured within the pocket, and the ends of the extruded pocket-forming pieces cut away, leaving a metal frame having an interior and an exterior portion, each joined to the other through an insulative medium, thereby creating an effective thermal break between the exterior and interior surfaces of the frame. However, the expense of manufacturing such a frame is high due to the final step of cutting the frame to form the thermal break, a time consuming procedure.

SUMMARY OF THE INVENTION

The subject invention is an improvement over the metal frames and metal doors of the prior art allowing for a positive thermal break between the exterior and interior components of the frame. This frame may be formed in situ if desired, and requires no associated hardware to retain the integrity of the thermal break. The method and apparatus of this invention includes a metal interior frame portion insulatively interconnected with a metal exterior frame portion. The point of interconnection or joinder of the interior and exterior is formed by mating the frame member extending perpendicularly inwardly from each of the exterior and interior surfaces. These mating members are positively spaced from one another through a woven cloth or matted fabric disposed between the members and adhesively joined or bonded to one another through a liquid resin which is held in contact with the mating members and the fabric until cured. In this manner, the fabric insures that the respective members do not come into contact with one another and the cured resin provides a strong structural bond and retains the mating members in the proper thermal break position, insuring that there will be the transfer of heat from the interior to the exterior will be restricted or reduced; thereby reducing or eliminating drafts and condensation on the interior surfaces. Of course, metal doors may be constructed in the same manner to provide thermal breaks at the joinder of the exterior metal surface with the interior metal surface.

Therefore an object of the subject invention is a means of insulating the exterior surfaces of window and door frames from their interior surfaces.

A further object of the subject invention is a method and apparatus for providing a positive thermal break between the exterior and interior surfaces of a window or door.

A still further object of the subject invention is a means of eliminating condensation on the interior surfaces of window frames and the like.

A still further object of the subject invention is a metal framework, structural member for the walls of buildings and the like with a thermal break between the interior wall and the exterior wall.

Further objects of the invention, together with additional features contributing thereto and advantages accruing therefrom, will be apparent from the following description of one embodiment of the invention when read in conjunction with the accompanying drawings wherein:

DESCRIPTION OF THE INVENTION

Figure 1:
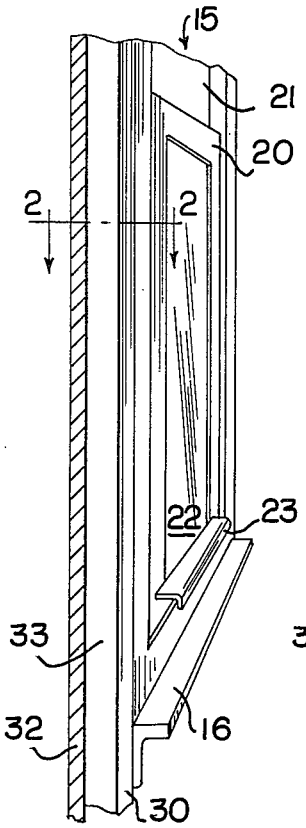
FIG. 1 is a perspective view of a window frame utilizing the thermal break of the subject invention.

Referring now to FIG. 1, there is shown a window assembly 15 hung in a conventional manner within the inventive metal framework. The window comprises a lower windowpane 22 and an upper window 21 within the framework 30. These windows are slidable within the outer frame for opening and closing purposes. The lower window frame 20 may have a hand grip 23 for use in sliding the lower window 22 within the outer frame 30. A windowsill 16 may be provided as desired.

The window frame 30 of the subject invention comprises a metal outer frame portion 33 and a metal inner frame portion 35. The frame is secured within the outer wall 32 as more specifically shown in FIG. 2 through a channel means 36, or other appropriate retaining means. In a similar fashion, the interior wall 38 of the structure is retained through a similar channel 37 located on the interior frame portion 35. The interior frame portion 35 is insulatively attached to the exterior frame portion 33 in such a manner as to provide a thermal break at their joinder 31, as will be explained later.

A window frame 20 slides vertically within the exterior framework 30 and is retained within the framework 30 by conforming to and riding within a channel 34 without contacting the frame joint 31. The panes of glass 22, here shown as a double glazed window, are retained in appropriate channels 28. The interior of window frame portion 25 is insulated through thermal breaks 26 similar to thermal breaks 31.

Figure 5:
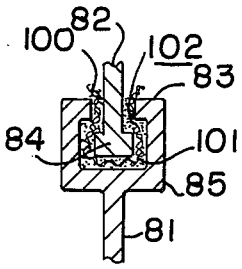

The thermal break of the subject invention comprises a joint of two mating and interlocking frame members such as 81 and 82 in FIG. 5. In this embodiment, frame member 82 terminates in a T-bar portion 84 while frame member 81 forms a partially enclosed U-shaped channel having channel arms 85 terminating in inward extensions 83 which, when joined, complements the T-bar portion 84 for a strong interlocking joint. To form the thermal break joint of the subject invention, a cloth fabric, such as fiberglass fabric, is wrapped about the T-portion 84 of the frame member 82, covering this T-portion 84 completely. The wrapped T-portion 84 is then inserted into the spacing or cavity formed by channel arms 85 of the mating frame portion 81. A suitable resin 101 fills the spacing or cavity 102 surrounding and saturating the fabric. When the resin is cured, it provides a strong bond between the two mating frame members 81 and 82 which is reinforced to provide a strong joint by the inwardly extending portions 83 of the frame members 81 in combination with the T-portion 84 of frame member 82. In addition, the fabric 100 provides a positive spacing between frame member 81 and frame member 82, thereby providing a complete thermal break or insulation between the exterior frame portion and the interior frame portion of the framework.

The resin to be used may be any suitable plastic material which may be easily cured into a hardened mass, adherent to metal and having highly insulative properties. In general, polyester resins have been found suitable for this purpose and may be easily cured with a catalyst or hardener such as methyl ethyl ketone peroxide. In one embodiment, the resin and catalyst marketed by Balkamp Incorporated under the trademark "BALKAMP" Fiberglass Repair Kit was found to perform satisfactorily.

Figure 6:
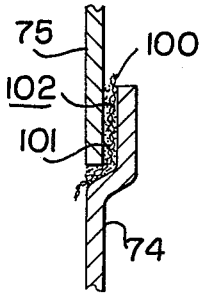

Various other embodiments may be used in constructing the inventive insulative joint. As shown in FIG. 6, frame members 75 and 74 may be adhesively joined together, frame member 74 having an offset end portion which is positively spaced from frame member 75 through the fabric 100 and then joined securely by the resin 101 in the cavity 102.

Figure 7:
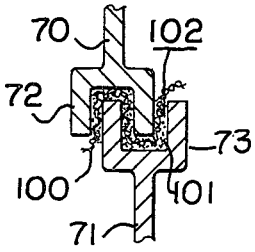

FIG. 7 shows yet another embodiment having two identical end portions 70 and 71 which may be joined together by inserting one of the channel arms 73 of frame 71 into the channel formed by arms 72 of frame member 70. In this manner a positive spacing in the shape of an "S" is formed within the channels 102 by the fabric 100. The resin 101 is allowed to harden within this channel to form the thermal break and adhesively join the two frame members.

Figure 8:
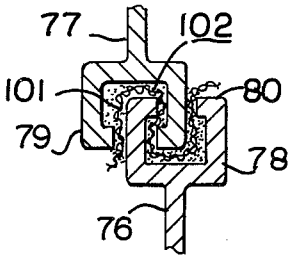

FIG. 8 is similar to FIG. 7 with the addition of inwardly extending arm portions 80 on each channel arm 78 and 79 of the frame members 76 and 77, respectively.

Figure 9:
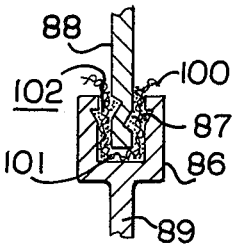

FIG. 9 comprises a channel conforming member 86 having notches or indentations 87 on the channel arms and channel interior. The mating frame member 88 has similar notches or indentations 89 at one end thereof. Thus, when the fabric 100 is placed between frame member 88 and frame member 86 and the resin 101 is placed in the channel 102 and cured, the indentations 87 provide extra holding power and give added strength to the insulative joint.

Figure 2:
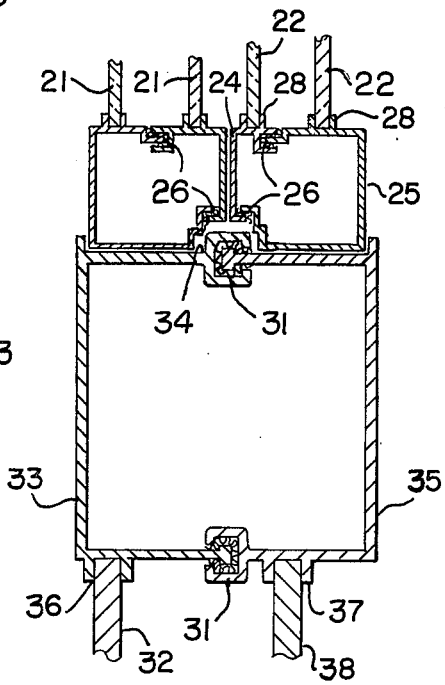
FIG. 2 is a cross section taken along the lines 2—2 of FIG. 1 showing the thermal break portions of the frame and the window.
Figure 10:
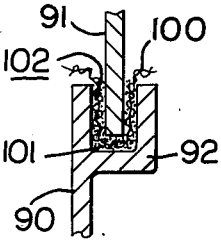

FIG. 10 shows still another embodiment of the insulative joint of the subject invention whereby an "H" shaped frame member 90 mates with a straight frame member 91 to provide a thermal break as is seen in the window frame of FIG. 2.

The above described joints may be formed either at the job site or be preassambled at the factory. When forming the thermal break of the joint on the job site, two methods may be employed. After forming the respective frame members to the correct size, one frame member is secured in place to the foundation or building supports. The other frame member is then coupled with the secured frame member, being careful that the fabric is at the interface of the two frame members, allowing no contact between the metal surfaces of the two coupled frame members. Resin may be poured or flowed into the cavity thereby formed and allowed to cure. The two frame members are thus rigidly held together by the thermal break to form an integral frame which will not conduct heat or cold to the interior of the building.

The manner of preassemby in a factory setting is essentially the same, permitting the window to be hung either as a unit or by cutting the prejoined frame members to size.

Figure 3:
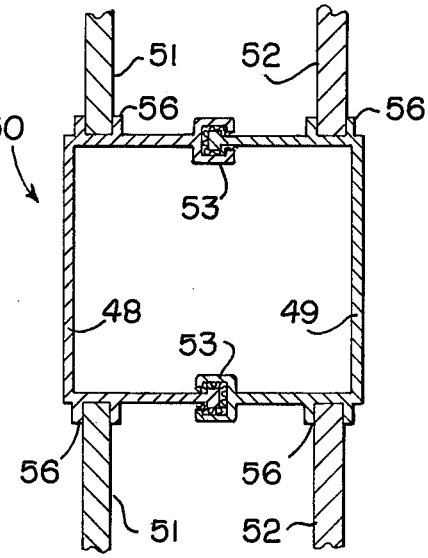
FIG. 3 is a cross section of a structural component of a building utilizing the thermal break of the subject invention.

The inventive thermally insulative joint may be used in applications other than window frames. For instance, as shown in FIG. 3, the subject joint may be an integral part of the structural framework of a building taking the place of the standard 2 × 4's, etc., in common use in the building of residential structures. This structural support 50 supports an interior wall 51 and an exterior wall 52 in a thermally spaced relationship. The interior wall may be wallboard or drywall secured to the structural support 50 on any conventional means such as the channel 56. The exterior wall 52 may be of wood or other suitable exterior material and secured to the structural support 50 in the same manner as the interior wall. Siding may be placed over the exterior wall if desired, in the conventional manner. The interior structural support section 48 is joined to the exterior structural support section 49 at joints 53. These joints incorporate the placement of a fabric in combination with a resin to provide a positive break between the interior and the exterior sections, while at the same time bonding the two sections for a strong structural support.

Figure 4:
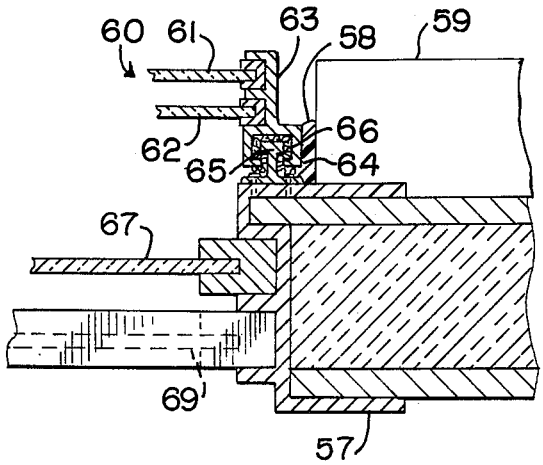
FIG. 4 is a cross section showing storm windows utilizing the thermal break of the subject invention secured over an existing conventional window; and, FIGS. 5–10 are cross sections of various connective joints using the thermal break of the subject invention.

The subject inventive insulative joint may also be used as an addition to existing buildings, of any type construction, to add to the insulating properties of its windows. Thus, as shown in FIG. 4, storm windows 61 and 62 incorporating the inventive thermal break may be added to the existing metal framed windows of a building. As shown in FIG. 4, generally the windows in major buildings are recessed from the exterior surface 59 of the building. For such a window frame, the primary support 65 is first firmly affixed to the existing metal window frame 57 which slidingly supports the upper windows 67 and the lower windows 69 in a conventional manner. Storm window supports 65 may have a T-bar for engagement with the mating panel portion 64 having the thermal break 66 between the two mating portions, as shown in more detail in FIG. 5 and as explained above. Storm windows 61 and 62 would then be mounted in a conventional sliding fashion to framework 63. The metal frame 57 and the window support 65 would be sealed and insulated from thermal loss or gain by the application of a suitable caulking agent 58 between the building exterior portion 59 and the window frame 63 in a manner well known in the art. In this manner, the storm window does not allow the conduction of heat to the metal window frame for subsequent conduction to the interior of the building, while the storm window frame 63 has a size which is kept to a minimum and does not significantly alter the appearance of the window by increasing its apparent size.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

I claim:

1. The method of forming a metal frame for windows, doors and the like to provide a thermal break between the interior surfaces and the exterior surfaces of said metal frame, said method comprising the steps of:
   - forming an exterior metal strip and an interior metal strip, each of said metal strips terminating in an interconnectable joint portion;
   - placing a fabric over the joint portions of one of said exterior metal strip or said interior metal strip to completely cover said joint portion;
   - joining said exterior metal strip to said interior metal strip by interconnecting said joint portions, thereby forming a spacing between said joint portions;
   - retaining said fabric intermediate said exterior joint portion and said interior joint portion in said spacing;
   - filling said spacing with resin, and impregnating said fabric with said resin, and
   - curing said resin to provide for a metal frame joint which positively spaces said interior metal strip from said exterior metal strip to restrict the conduction of heat in said frame.

2. The method of claim 1 whereby each of said interior metal strip and said exterior metal strip are formed into generally U-shaped channels with a base and at least two side portions, each of said side portions terminating in an interlockable joint portion.

3. The method of claim 2 whereby said interior metal strip is joined to said exterior metal strip by interlocking the respective joint portions.

* * * * *